United States Patent [19]

Payne et al.

[11] 4,014,068

[45] Mar. 29, 1977

[54] BRUSH MOUNTING AND TORSION SPRING SUPPORT FOR POWERED NOZZLE

[75] Inventors: Rex E. Payne; Henry F. Aegerter, Jr., both of Massillon, Ohio

[73] Assignee: The Hoover Company, North Canton, Ohio

[22] Filed: Apr. 3, 1975

[21] Appl. No.: 564,808

[52] U.S. Cl. ..... 15/355; 15/360; 15/373

[51] Int. Cl.[2] ..... A47L 9/06

[58] Field of Search ..... 5/339, 355, 359, 360, 5/368, 371, 373

[56] References Cited

UNITED STATES PATENTS

| | | | |
|---|---|---|---|
| 2,205,877 | 6/1940 | Dunbar | 15/368 |
| 2,348,861 | 5/1944 | Smellie | 15/371 X |
| 2,874,400 | 2/1959 | Burrage | 15/359 |
| 2,938,225 | 5/1960 | Carabet | 15/359 X |
| 2,948,014 | 8/1960 | Allen | 15/371 |
| 3,821,831 | 7/1974 | Grover | 15/371 X |
| 3,952,363 | 4/1976 | Lindman | 15/373 |

*Primary Examiner*—Christopher K. Moore

[57] ABSTRACT

A vacuum cleaner nozzle is provided having resilient means, disposed between it and its handle, to prevent displacement of the nozzle from the floor during cleaning and also having a litter collecting brush that is spring biased into floor engaging position and height adjustable so that the nozzle is usable on bare floor and carpeted surfaces. Height adjustment is occasioned by a reciprocal bar having dimpled camming surfaces formed integrally in its top surface, with this bar being lever actuated and including an indicating means to guide the user during cleaning.

12 Claims, 7 Drawing Figures

Fig 5
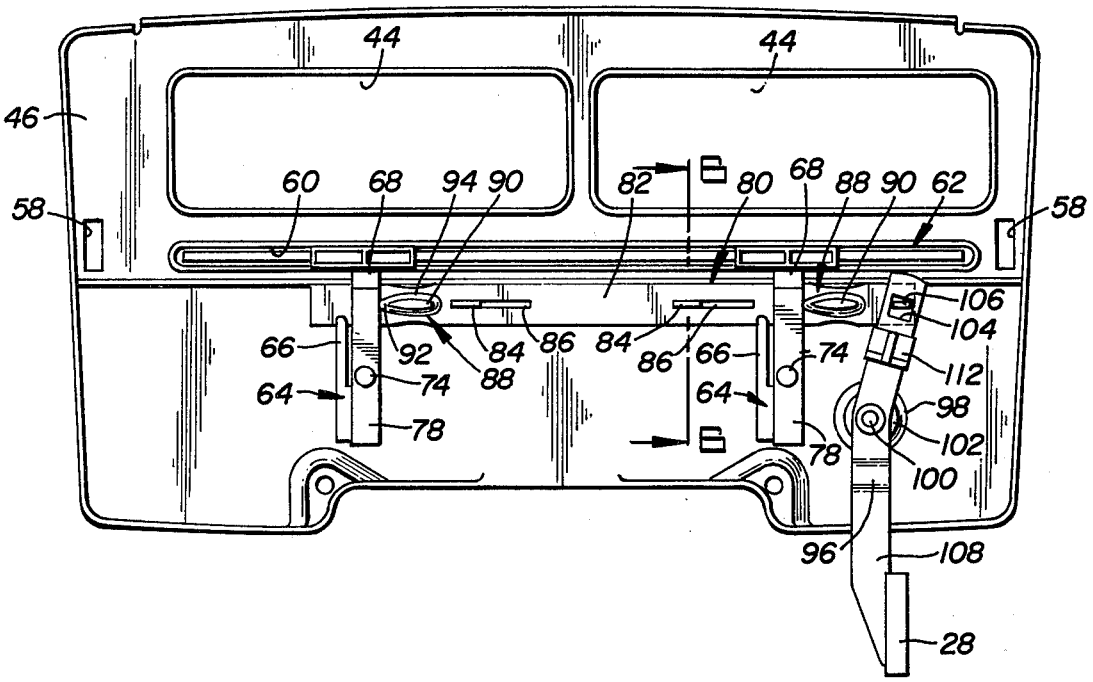
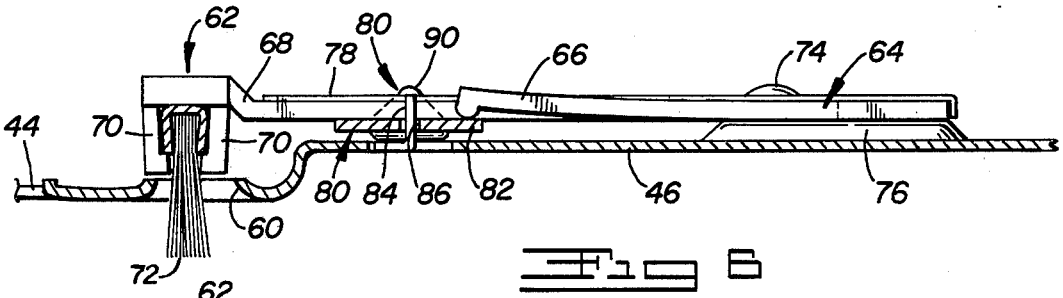
Fig 6
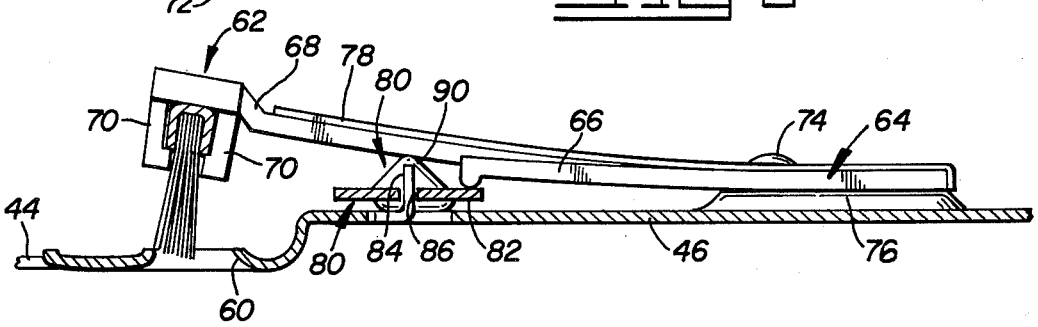
Fig 7

BRUSH MOUNTING AND TORSION SPRING SUPPORT FOR POWERED NOZZLE

BACKGROUND OF THE INVENTION

1. Field of the Invention

This invention relates to nozzles for use with vacuum cleaners and, more specifically, to a powered nozzle advantageously applied to bare floors, carpets and the like by the use of a wand like handle normally present on the hose end of a canister cleaner.

2. Description of the Prior Art

Although counter-balance springs are broadly old in the cleaner art, the showings of such consisting of tension, compression and torsion springs arraged in a variety of ways, it appears that the use of a torsion spring disposed so that its actual reaction points are against the bottom of a cleaner handle or member serving this purpose and the bottom side of a nozzle to thereby prevent lifting of the rear of the nozzle during cleaning has not heretofore been contemplated. More specifically, the use of such a spring arrangement in an independent, remote, free standing nozzle appears to be devoid in the prior art. At the same time, the use of a torsion spring so arranged provides very effective control of nozzle lift during rearward movement of the nozzle during cleaning and also permits ease in manufacturing because of the simplified mounting necessary.

The use of a resiliently mounted and height adjustable brush in such a nozzle is also old in the prior art and does advantageously permit flexibility in the cleaning surfaces for which the nozzle is effective. However, previous mounting arrangements for brushes of this sort are generally fairly costly in that they use specially shaped parts requiring special molds, complex stampings or the like or are not as direct acting or as flexible in positioning or as readily accessible to the user as the instant height adjustable brush arragement. Further, ease in coupling of the adjustable brush arrangement to an indicator means easily seen by the user is desirable.

Accordingly, it is an object of this invention to provide a torsion spring counterbalance arrangement for a nozzle in which the reaction points of the torsion spring are between the bottom of the handle and the bottom of the nozzle so as to counterbalance the nozzle and prevent lifting of the same during backstroke movement of the nozzle as cleaning occurs.

It is a further object of the invention to provide a simplified resilient, height adjustable brush for a nozzle in which the mounting and adjusting structure lends itself easily to accessibility for operator manipulation and permits easy attachment to a view-accessible indicator arrangement.

It is a still further object of the invention to combine the anti-lift feature provided by the described torsion spring and the resiliently mounted height adjustable brush in a single nozzle so as to obtain an improved easily operated nozzle readily adaptable to perform the remote cleaning function so common in today's canister cleaners.

SUMMARY OF THE INVENTION

In a preferred embodiment of the invention a nozzle for use with a wand or like member includes a torsion spring disposed about an axle for a pair of rear wheels providing transport for the nozzle. This spring has its reaction points at the bottom side of the wand and the bottom side of the nozzle forward of the wheel axle. It thereby provides a counterbalance force tending to maintain rearward portions of the nozzle in contact with a floor or rug being cleaned during rearward movement of the nozzle towards the user.

Additionally, in order to provide for flexibility of use, the nozzle also includes a brush member that is resiliently biased downwardly by a pair of leaf springs attached to the top side of a bottom plate for the nozzle. Between the top of the bottom plate and a bottom side of the leaf spring a camming bar is disposed. This bar includes a pair of spaced, tear shaped upwardly extending, projections formed therein by a conventional stamping operation. The tear shaped projections are the actual camming means for the brush and are arranged, as the camming bar reciprocates from side to side, to, in effect, engage against the leaf springs and cam the same upwardly. Because of these height adjustment cams, different brush settings are available for nozzle use. Thus, bare floors, short shags, regular pile and heavy shags, for example, are accommodated by the instant nozzle.

This bar is guided in its reciprocating movements by a pair of slots contained therein which carry tabs struck from the bottom plate. A lever, pivoted to the bottom plate and extending rearwardly therefrom, is provided to manually actuate the camming bar, the lever being attached to this bar by a tab and slot connection to accommodate the swinging motion of the lever. An indicator projects upwardly from the lever so as to extend through an aperture in an upper shell of the nozzle to be easily viewed by the user.

The upper shell of the nozzle also includes a series of compartments for housing the agitator motor, belt drive and rotating agitator. The compartment within which the rotating agitator is disposed connects with suction (through the wand) by means of a flexible conduit extending, in effect, through the rearward wall of the agitator compartment and attached, at its other end, to a wand coupling member that include bosses utilized for mounting it to a rear axle of the nozzle.

The bottom plate has an elongated opening in its forward portion through which the rotating agitator extends and through which suction is applied to the rug or floor being cleaned. A narrower elongated opening behind the rotating agitator opening permits resilient extension of the leaf spring mounted fixed brush. Outwardly (sidewardly) of the fixed brush aperture are a pair of wheel openings that permit small forward wheels mounted on the upper shell to extend downwardly into contact with the floor or rug.

The nozzle is completed, generally, by the addition of a wand lock arrangement including a locking pawl mounted with the wand connecting piece. This locking pawl engages a spring biased latch on the upper shell to provide a locked storage positon for the wand connector.

DESCRIPTION OF THE DRAWINGS

Reference may now be had to the accompanying drawings for a better understanding of the invention, both as to its organization and function, with the illustration being only exemplary, and in which:

FIG. 5 is a top plan view of the bottom plate and attached structure;

FIG. 6 is a partial, sectional elevational view taken on line 6—6 of FIG. 5 with the adjustable brush fully extended; and FIG. 7 is a view similar to that of FIG. 6 but showing the adjustable brush fully retracted.

DESCRIPTION OF THE PREFERRED EMBODIMENT

Figure 1:
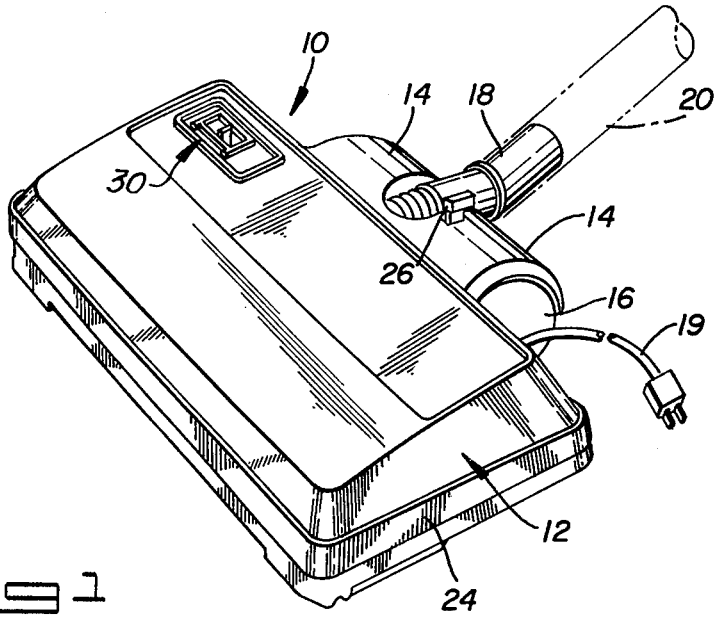
FIG. 1 is a perspective view of a nozzle incorporating the invention.
Figure 2:
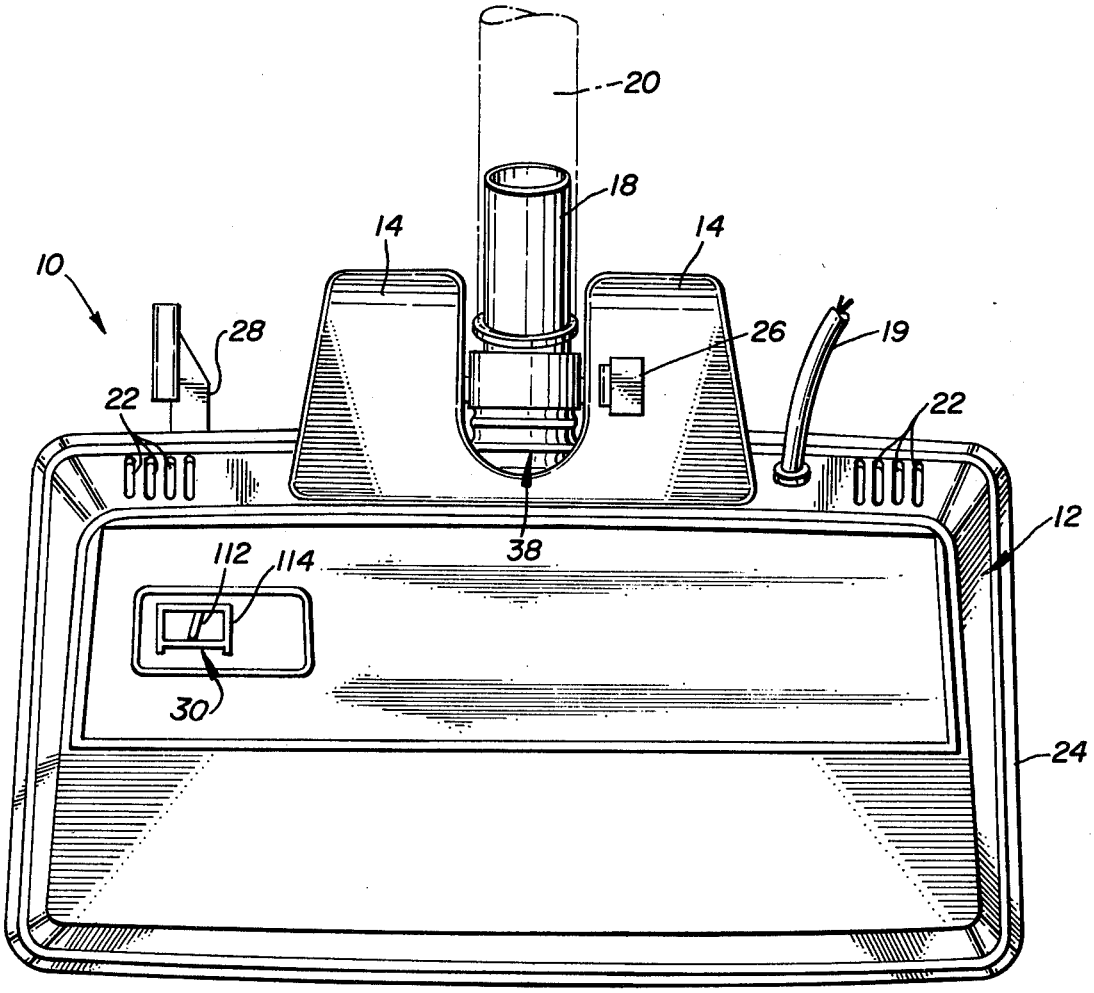
FIG. 2 is a top plan view of the same nozzle.

As is shown most clearly in FIGS. 1 – 2, a powered nozzle 10 includes a downwardly opening upper shell 12 having rearward bosses 14, 14 that support a pair of large rear wheels 16, 16. Attached to the powered nozzle 10 is a hose coupling or wand member 18 that may confluently communicate with a wand 20 (only partially shown) or the like, the same to be utilizable as a propelling handle for the nozzle 10. An electric cord 19 provides power to the nozzle 10.

The upper shell 12 includes a series of vents 22, 22 disposed on opposite sides of the hose coupling member 18 for ventilation of the motor contained therein. A furniture guard 24 extends around nearly the whole periphery of a lower portion of the upper shell 12 so as to provide protection for both the nozzle 10 and furniture in the area where cleaning occurs. Also found in FIGS. 1 and 2 are a foot actuated pedal 26 for locking adjustment of the wand and a foot or hand actuated pedal 28 for brush height adjustment. The mechanism connected with foot actuated pedal 28 for brush height adjustment also includes an indicating means 30.

Figure 3:
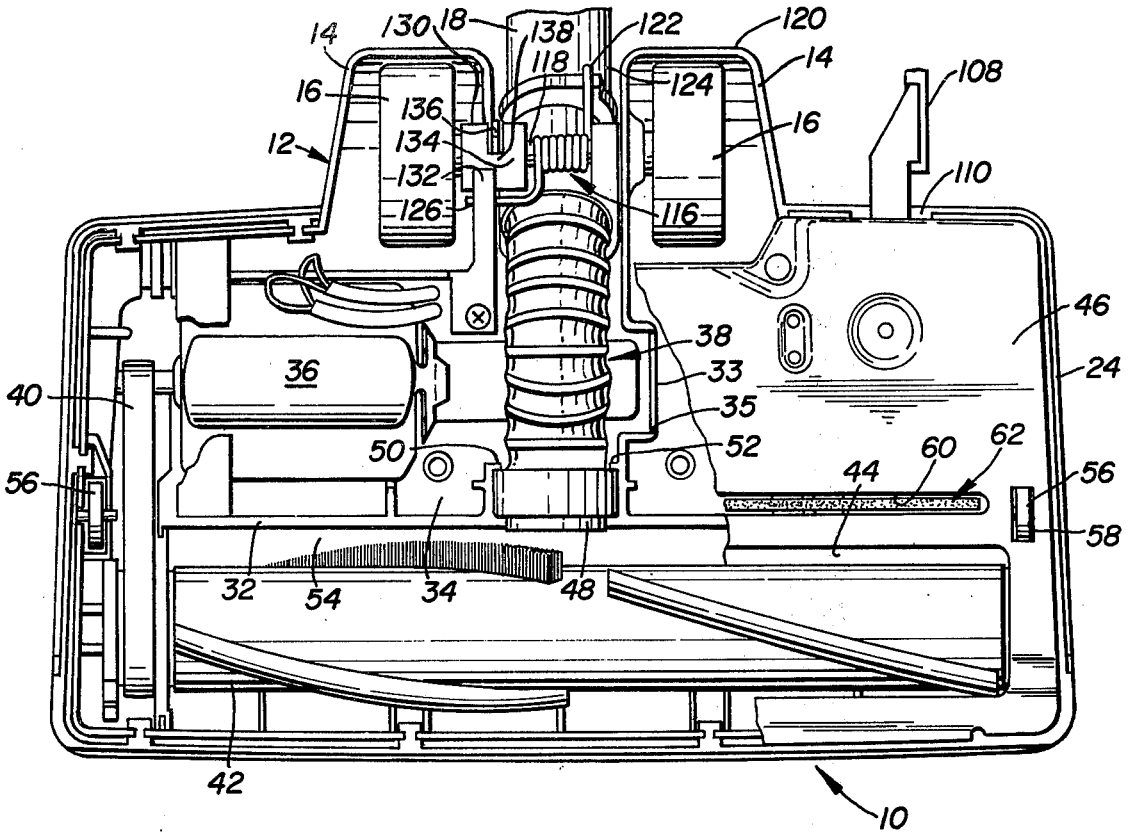
FIG. 3 is a bottom plan view, partly broken away to better illustrate the invention.
Figure 4:
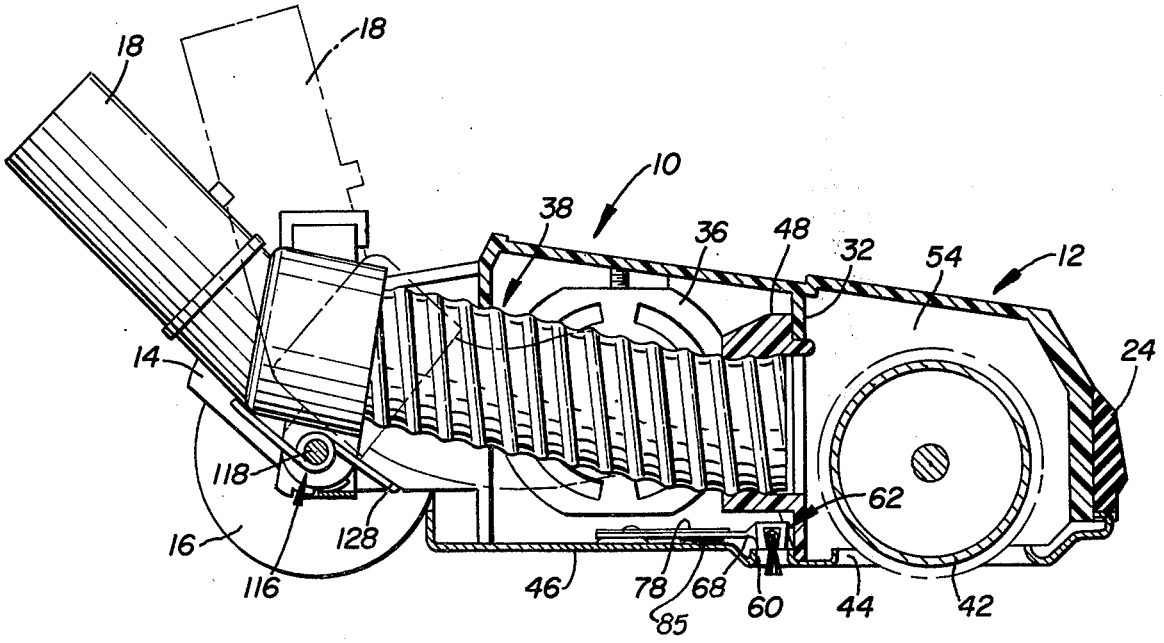
FIG. 4 is a cross sectional elevational view of the invention taken looking from the right half side of FIG. 3.

Turning now to the remaining Figures of the Drawings, the upper shell 12 is seen as including a wall 32 (FIG. 3) extending outwardly from its underside and from side to side relative to the width of the nozzle 10. This wall provides a compartment 34 within the upper shell 12 bounded by it, the outer walls of the upper shell 12 and another wall 33 extending rearwardly from the wall 32 and in which a motor 36 and suction conduit means 38 are mounted.

Motor 36 drives a belt 40 which extends around and is in driving contact with a rotating agitator 42 journalled in the upper shell 12 and extending through a pair of elongated apertures 44, 44 in a bottom pan or plate 46 (FIG. 5) that completes the peripheral outline of the powered nozzle 10. Suction conduit means 38 includes at its front a mounting flange 48 that is captured by a pair of flanges 50, 52 formed as integral extensions of the walls 32 and 33, respectively, so that the suction conduit means 38, at its front end, confluently communicates with another chamber 54 formed forwardly of the wall 32 in power nozzle 10. The rotating agitator 42 is also disposed within this chamber so that it is housed in the suction area of the power nozzle 10, with the elongated apertures 44, 44 in bottom plate 46 thereby providing a means to impose a vacuum on the surface being cleaned to pick up dirt and dust from this surface.

The upper shell 12 also journably mounts a pair of small forward rollers 56, 56 on formed ribs or the like (not shown) with the same extending through apertures 58, 58 in bottom pan 46, outwardly of the apertures 44, 44 so that these rollers provide stability in their floor contacting position. An elongated single aperture 60, substantially coextensive in length to the combined lengths of apertures 44, 44, is also disposed rearwardly of apertures 44, 44 for the rotating agitator 42. The aperture 60 has disposed in extending fashion within it, an elongated resiliently mounted brush means 62 utilized to provide an anti-kickback function to the power nozzle 10.

Insofar as related the power nozzle 10 is substantially conventional, the novelty residing therein relating to the manner of adjusting resiliently mounted brush means 62 and the manner of counterbalancing the powered nozzle 10.

Resiliently mounted brush means 62 includes a pair of plastic holders 64, 64 each having an elongated finger 66 and a brush holding extension 68. The brush holding extension 68 includes integrally laterally extending and depending hook portions 70, 70 that latchingly and clampingly hold a brush 72 therebetween to fixedly mount the brush into each of the plastic holders 64. The plastic holdrs 64, 64 are each attached to bottom pan 46 by a rivet 74 that mounts the same to a raised boss 76, formed in the bottom pan and, because of the depth of the bosses and the relative depth of brush 72, the plastic holders 64, 64 tend to extend the brush 72 almost completely through aperture 60 of bottom pan.

Although the plastic holders 64, 64 are somewhat resilient, in order to insure that sufficient resilient bias is imposed on the brush 72, a separate leaf spring 78 is provided for each of the plastic brush holders 64. Each of these springs overlies the major portion of one of the brush holder extensions 68 to urge the same downwardly to insure proper brush contact with the floor or rug. Leaf spring 78, in turn, is also connected to bottom pan 46 by rivet 74 and held by it tightly against brush holder extension 68. The brush 72 is thereby, positively resiliently urged downwardly.

In order to adjust resiliently mounted brush means 62 in or out a height adjustment means 80 is provided. This means includes a reciprocating bar 82 mounted for guidance on bottom pan 46 and being made of flat steel stock and disposed flat against the top side of the bottom plate. A pair of bent tabs, 84, 84 are struck from the bottom pan, so as to extend perpendicular from it so that these tabs are received in a pair of longitudinally extending grooves 86, 86 formed in reciprocating bar 82, to thus form the guidance arrangement for it. The reciprocating bar 82 also includes cam means 88 formed by two tear shaped cams 90, 90 spaced outwardly of the grooves 86, 86. These tear shaped cams are embossed in the reciprocating bar 82 by a conventional pressing operation and provide a pair of elongated bumps which gradually increase in height from a minimum 92 to a maximum 94 at substantially this widest point (i.e., laterally of the nozzle 10) so as to provide an incremental plurality of series of adjustments (if desired) when interposed between the bottom pan 46 and plastic brush holder means 64. The brush 72 can be seen in its maximum extension in FIGS. 5 and 6 when the cams are disengaged, while FIG. 7 illustrates the brush at its minimum extension. These are normally the two positions at which the powered nozzle 10 is operated.

As can be seen, then, height adjustment for the brush 72 is obtained by selective inter position of the tear shaped cams 90, 92 between the bottom surface of plastic brush holders 64, 64 and the top surface of the bottom pan. This provides a positive, direct height adjustment action and, at the same time, provides a structure in which the reciprocating bar 82 is automatically captured against the bottom plate by the resilient and resiliently biased plastic brush holding extensions 68, 68 and leaf springs 78, 78 without the use of additional structural elements. The elongated fingers 66, 66 may also be utilized to perform a portion of this "capture" function but they may also be dispensed with entirely.

A pair of downwardly formed bosslike tabs 85, 85 (only one shown) may also be desirably formed on the bottom surface of flat, reciprocating bar 82 to limit its sliding area engagement with the top surface of bottom pan 46 and to provide for proper spacing of the plastic brush holders 64, 64 away from the top surface of bottom pan 46 at their forward portions in much the manner that the bosses 76, 76 accomplish this function at their rearward portions.

Rectilinear motion is imparted to reciprocating bar 82 by a crank lever 96 that is pivoted to bottom plate 46 on a boss 98 by a rivet 100. A washer 102 may be interposed between the head of the rivet 100 and the lever 96 to insure proper nonbinding action for the lever 96. At its inner end, crank lever 96 includes a rectangular groove 104 within which is nested a bent up, integral tab 106 on reciprocating bar 82, the groove 104 and tab 102 accommodating the pivoting action of lever 82 as it imposes rectilinear, reciprocating action to bar 82. Crank lever 96 is, of course, limited in its pivoting action by engagement of the integral tabs 84, 84 in opposite ends of the grooves 86, 86, with these portions shown in FIGS. 6 and 7, respectively.

Crank lever 96 also includes a foot or a hand extension portion 108, on which is mounted the outwardly disposed pedal 28, for ease in manipulation of reciprocating bar 82 by the user of powered nozzle 10. A slot 110 in upper sheel 12 accommodates the extension portion 108 of crank lever 96 as it passes therethrough. Also mounted with crank lever 96 is an upwardly projecting indicator 112 of brush height adjusting means 30. The indicator may be attached by any conventional means to crank lever 96 such as by hook means (not shown) like the hook portions 70 and is desirably colored so that it is easily discernable as it extends through a viewing aperture 114 formed in upper shell 12 and comprising a part of brush height indicating means 28. By this structure, then, there has ben provided a dual-position resiliently mounted brush height adjustment means and connected indicating means both direct acting and direct reading and thereby thoroughly satisfactory to the user of the powered nozzle 10.

Powered nozzle 10 also includes a counterbalance spring means 116 tending to urge the rearward end of powered nozzle against the surface being cleaned during the backstroke of the nozzle (towards the user). Counterbalance spring means 116 takes the form of a torsion spring wound on an axle 118 for rear wheels 16, 16. This axle, in turn, is fixedly mounted to a pair of rearwardly extending portions 120, 120 of upper shell 12. The reaction points for the torsion spring are formed by an end 122 thereof engaging against a portion 124 of the hose coupling member 18 and an end 126 engaging against the bottom of powered nozzle 10 in the upper termination of a formed receiving groove 128. Thus, movement of the wand 20 during cleaning tends to increase or decrease spring pressure on the nozzle body so that, as the wand 20 is swingably lowered during the forward stoke (FIG. 3), greater spring pressure is imposed on the nozzle rearward end shifting some of its weight forwardly on the agitator. Moving the nozzle rearwardly raising the wand 20 decreases the spring force on the nozzle body but sufficient spring force (approximately 6 pounds) remains to overcome the natural inclinaton of lifting of the rearward portions of the nozle from the surface being cleaned.

A nozzle lock means 130 is also provided, as is conventional, to lock the wand 20 in upper storage position. This locking means includes a resilient spring steel finger 132 that abuts against a latch member 134 to urge the same generally vertically, the latch member being vertically slot mounted on rear wheel axle 118. A locking pawl 136 fixed with and carried by the hose coupling member 18, also pivoted an axle 118, upon pivoting thereof, engages against a latch portion 138 of latch member 134 when the same is urged upwardly under the control of resilient steel spring finger 132. To disable the latch member 134, foot actuated pedal 26 is moved downwardly carrying latch member 134 to which it is rigidly attached downwardly thus providing clearance between the latch member 134 and locking pawl 136 so that wand 20 may be placed in the non storage, cleaning mode position.

It should be clear from the foregoing description that a nozzle has been provided having all the desirable characteristics set out for it and, further, that the preferred embodiment is exemplary only, many modifications occurring to one skilled in the art still falling within its spirit and purview.

What is claimed is:

1. A counterbalanced rug and floor nozzle having a handle and including:

a. a housing for forming the major portion of the outline of the nozzle, b. a bottom plate attached to said housing, c. an elongated aperture in said bottom plate, d. brush means mounted with said bottom plate and extending through said elongated aperture, e. means for mounting said brush means to said bottom plate for limited movement inwardly and outwardly of said nozzle, f. said mounting means including a leaf spring arrangement resiliently urging said brush means outwardly and adjustable means interposable between said leaf spring arrangement and said bottom plate for moving said brush means against said resilient urging to retract said brush means into said nozzle, g. said adjustable means including a generally flat bar lying against said bottom plate and having shaped protrusions formed integrally thereon so each smoothly varies in depth from a minimum adjacent its one end to a maximum adjacent its other end to thereby provide a smooth, gradual camming ramp and said bar reciprocal relative to said bottom plate to simultaneously interpose more or less of said shaped protrusions and thereby more or less of the depth of the camming ramps between said leaf spring arrangement and said bottom plate so that said brush means is adjustably moved inwardly and outwardly of said aperture, and h. torsion spring means attached to said hausing for reacting thereagainst for counterbalancing the same during use, said torsion spring having its other reaction point against said handle.

2. A counterbalanced rug and floor nozzle set out in claim 1 wherein;

a. said generally flat bar is guided in its reciprocal movements by tab and groove structure in said bottom plate and said flat bar.

3. A counterbalanced rug and floor nozzle as set out in claim 1 wherein;

a. said generally flat bar is moved in its reciprocating action by a lever attached thereto and pivoted to said bottom plate.

4. A counterbalanced rug and floor nozzle as set out in claim 1 wherein;

a. means for indicating brush height adjustment occasioned by said flat bar are provided attached to said flat bar.

5. A counterbalanced rug and floor nozzle as set out in claim 1 wherein;

a. said nozzle includes rearward portions mounting a wheel carrying axle, and b. said torsion spring is disposed about said axle.

6. A counterbalanced rug and floor nozzle as set out in claim 1 wherein;

a. said reaction point of said torsion spring with said housing is formed by the termination of a groove in said housing.

7. A counterbalanced rug and floor nozzle as set out in claim 1 wherein;

a. said flat bar is captured between said leaf spring arrangement and said bottom plate.

8. A counterbalanced rug and floor nozzle as set out in claim 1 wherein;

a. a lever is provided for actuation of said flat bar, and b. means for indicating brush height is mounted with said lever to move therewith.

9. A counterbalanced rug and floor nozzle as set out in claim 8 wherein;

a. spacing tabs are formed integrally with said flat bar, b. said spacing tabs ride on said bottom plate as said flat bar reciprocates to space the major planar extent of said flat bar from the portion of the bottom plate which it overlies.

10. A rug and floor nozzle having;

a. a downwardly opening housing, b. a bottom pan for said housing including a brush receiving aperture, c. a reciprocating flat bar lying against said bottom pan and movably attached to said bottom pan, d. tear shaped cams formed on said reciprocating flat bar, e. brush means mounted on said bottom pan and extending through said aperture and including means for mounting said brush means resiliently on said bottom pan, and f. said tear shaped cams being movably interposed between said mounting means and said bottom pan to thereby control the distance said brush means extends out of said aperture.

11. A rug and floor nozzle including;

a. a housing for forming the major portion of the outline of the nozzle, b. a bottom plate attached to said housing, c. an elongated aperture in said bottom plate, d. brush means mounted with said bottom plate and extending through said elongated aperture, e. means for mounting said brush means to said bottom plate for limited movement inwardly and outwardly of said nozzle, f. said mounting means including a leaf spring arrangement resiliently urging said brush means outwardly and adjustable means interposable between said leaf spring arrangement and said bottom plate for moving said brush means against said resilient urging to retract said brush means into said nozzle, g. said adjustable means including a generally flat bar lying against said bottom plate and having shaped protrusions formed integrally thereon, each having an equally smooth and varying depth, said generally flat bar reciprocal relative to said bottom plate to interpose said shaped protrusions between said leaf spring arrangement and said bottom plate, and h. said brush means extending outwardly of said nozzle dependent upon the depth of that portion of each of the shaped protrusions interposed between said leaf spring arrangement and said bottom plate.

12. The rug and floor nozzle of claim 11 wherein;

a. said integral protrusions on said generally flat bar are substantially tear shaped.

* * * * *

UNITED STATES PATENT OFFICE

CERTIFICATE OF CORRECTION

Patent No. 4014068 Dated March 29, 1977

Inventor(s) Rex E. Payne and Henry F. Aegerter, Jr.

It is certified that error appears in the above-identified patent and that said Letters Patent are hereby corrected as shown below:

Column 4, line 19: "holdrs" should be -- holders --

Column 5, line 36: "sheel" should be -- shell --

Column 6, line 6: "nozle" should be -- nozzle --

Column 6, line 14: "an" should be -- on --

Column 7, line 42: "the" second occurrence, should be -- that--

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*